US011794968B2

(12) United States Patent
Hsu

(10) Patent No.: US 11,794,968 B2
(45) Date of Patent: Oct. 24, 2023

(54) CABLE TIE

(71) Applicant: Jung-Lang Hsu, Taichung (TW)

(72) Inventor: Jung-Lang Hsu, Taichung (TW)

( * ) Notice: Subject to any disclaimer, the term of this patent is extended or adjusted under 35 U.S.C. 154(b) by 0 days.

(21) Appl. No.: 17/945,307

(22) Filed: Sep. 15, 2022

(65) Prior Publication Data

US 2023/0014377 A1 Jan. 19, 2023

Related U.S. Application Data

(63) Continuation-in-part of application No. 29/713,922, filed on Nov. 19, 2019, now Pat. No. Des. 974,895.

(51) Int. Cl.
*B65D 63/10* (2006.01)

(52) U.S. Cl.
CPC ..... *B65D 63/1072* (2013.01)

(58) Field of Classification Search
CPC . A45F 5/02; A45F 5/021; A45F 5/004; A44C 3/001; B65D 63/1027; B65D 63/1072
See application file for complete search history.

(56) References Cited

U.S. PATENT DOCUMENTS 3,837,047 A * 9/1974 Bunnell ..... B65D 63/1072 24/16 PB
3,887,965 A * 6/1975 Schuplin ..... B65D 63/1063 248/74.3
4,263,697 A * 4/1981 Speedie ..... B65D 63/1081 24/17 AP
4,910,831 A * 3/1990 Bingold ..... E05B 75/00 292/307 R
D313,547 S 1/1991 Buckles
D326,406 S 5/1992 Anderson
D424,417 S 5/2000 Axelsson
D530,600 S 10/2006 Krisel et al.
D537,333 S 2/2007 Jowsey
D565,401 S 4/2008 Grady et al.
7,520,030 B2 * 4/2009 Laporte ..... F16L 3/2332 24/16 PB
D619,887 S * 7/2010 Colton ..... D8/396
7,774,905 B2 8/2010 Geiger
D631,731 S 2/2011 Chen
D835,495 S * 12/2018 Votel ..... D8/356
10,717,572 B2 * 7/2020 Wiles ..... B65D 63/1072
(Continued)

*Primary Examiner* — David M Upchurch
(74) *Attorney, Agent, or Firm* — MUNCY, GEISSLER, OLDS & LOWE, P.C.

(57) ABSTRACT

A cable tie is provided, including: a locking head and a strap body. The locking head includes a plurality of first engaging teeth. The strap body is connected with the locking head. The strap body includes a first surface, a second surface and two lateral sides respectively connected between the first and second surfaces. The first surface includes a plurality of second engaging teeth and two protruding edges. The plurality of second engaging teeth are engageable with the plurality of first engaging teeth. The two protruding edges are disposed on two opposite sides of the plurality of second engaging teeth. A plurality of notched portions are disposed on the two lateral sides and interrupt the two protruding edges. Based on the first surface, a height of each of the two protruding edges is greater than a height of each of the plurality of second engaging teeth.

17 Claims, 5 Drawing Sheets

(56) References Cited

U.S. PATENT DOCUMENTS

| | | | | |
|---|---|---|---|---|
| 2006/0096066 | A1* | 5/2006 | Wambaugh ..... | B65D 63/1063<br>24/16 PB |
| 2009/0172922 | A1* | 7/2009 | Laporte ..... | B65D 63/1063<br>24/16 PB |

* cited by examiner

CABLE TIE

The present invention is a CIP of application Ser. No. 29/713,922, filed Nov. 19, 2019, the entire contents of which are hereby incorporated by reference.

BACKGROUND OF THE INVENTION

Field of the Invention

Description of the Prior Art

A conventional cable tie is made of plastic by injection molding and includes a locking head and a strap connected to the locking head. The strap has a plurality of ratchet teeth disposed thereon, and the locking head has a plurality of pawls engageable with the plurality of ratchet teeth. In operation, the strap is wound around an object and inserted through the locking head so that the plurality of pawls are engaged with the plurality of ratchet teeth to bundle the object.

However, the excess segment of the strap penetrating through the locking head is inconvenient to storage, and a cutter has to be used to remove the excess segment, which is inconvenient to operate.

The present invention is, therefore, arisen to obviate or at least mitigate the above-mentioned disadvantages.

SUMMARY OF THE INVENTION

The main object of the present invention is to provide a cable tie, which has good structural strength and is convenient to remove an excess segment of the cable tie.

To achieve the above and other objects, the present invention provides a cable tie, including: a locking head and a strap body. The locking head includes a plurality of first engaging teeth. The strap body is connected with the locking head and defines a longitude direction. The strap body includes a first surface, a second surface opposite to the first surface and two lateral sides respectively connected between the first surface and the second surface. The first surface includes a plurality of second engaging teeth and two protruding edges, and the plurality of second engaging teeth are engageable with the plurality of first engaging teeth. The two protruding edges are disposed on two opposite sides of the plurality of second engaging teeth. A plurality of notched portions are spacedly disposed on the two lateral sides and interrupt the two protruding edges, and based on the first surface, a height of each of the two protruding edges is greater than a height of each of the plurality of second engaging teeth.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
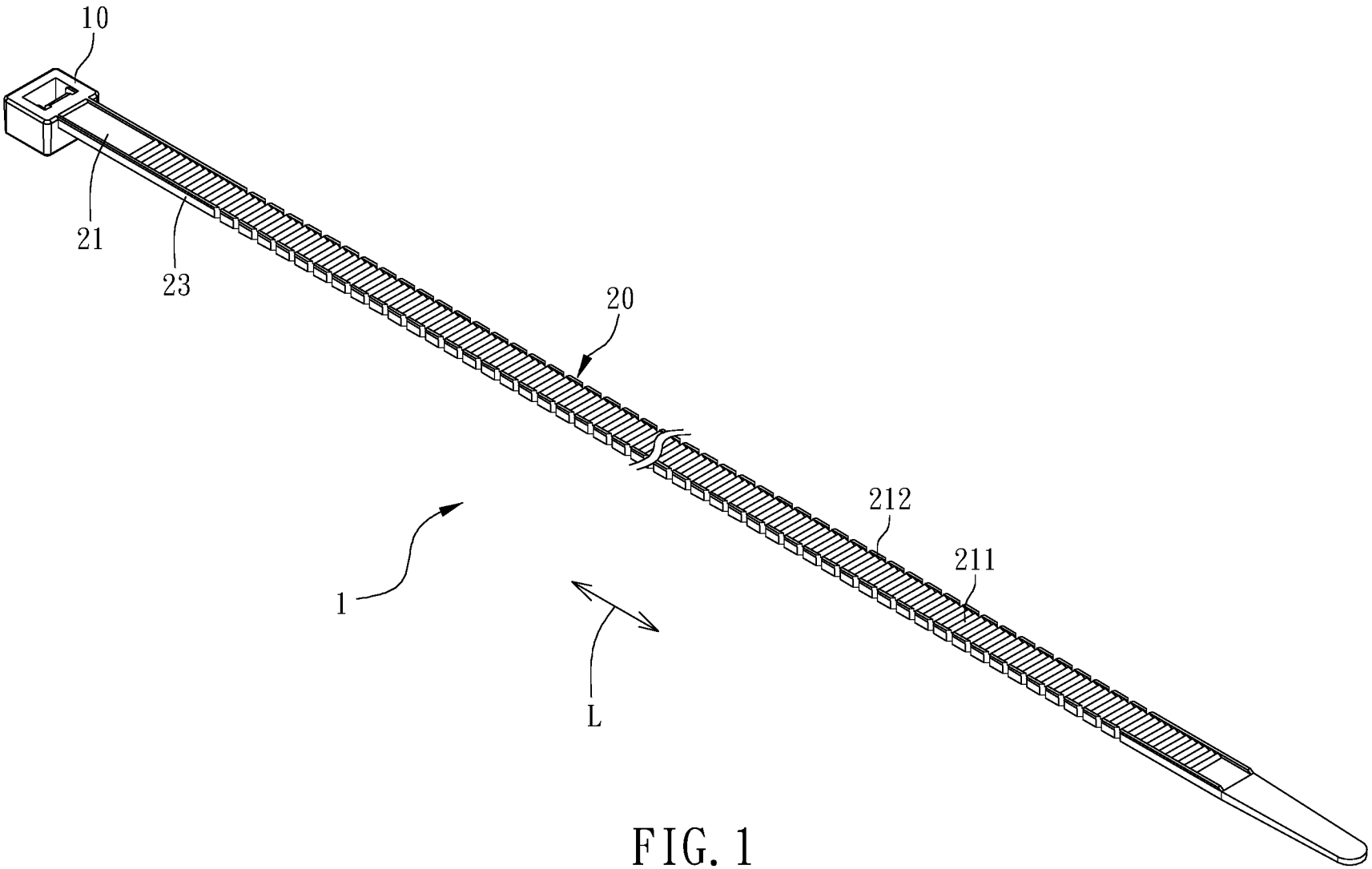
FIG. 1 is a stereogram of a preferable embodiment of the present invention.

Please refer to FIGS. 1 to 8 for a preferable embodiment of the present invention. A cable tie 1 of the present invention includes a locking head 10 and a strap body 20.

The locking head 10 includes a plurality of first engaging teeth 11. The strap body 20 is connected with the locking head 10 and defines a longitude direction L. The strap body 20 includes a first surface 21, a second surface 22 opposite to the first surface 21 and two lateral sides 23 respectively connected between the first surface 21 and the second surface 22. The first surface 21 includes a plurality of second engaging teeth 211 and two protruding edges 212, and the plurality of second engaging teeth 211 are engageable with the plurality of first engaging teeth 11. The two protruding edges 212 are disposed on two opposite sides of the plurality of second engaging teeth 211. A plurality of notched portions 24 are spacedly disposed on the two lateral sides 23 and interrupt the two protruding edges 212 so as to form a plurality of weaken segments on the strap body 20, which allows the strap body 20 to be disconnected via at least one of the plurality of notched portions 24 without cutting tools. Based on the first surface 21, a height H1 of each of the two protruding edges 212 is greater than a height H2 of each of the plurality of second engaging teeth 211 so as to increase a structural strength of the strap body 20 and avoid disconnecting the strap body 20 at an undesired position.

Figure 2:
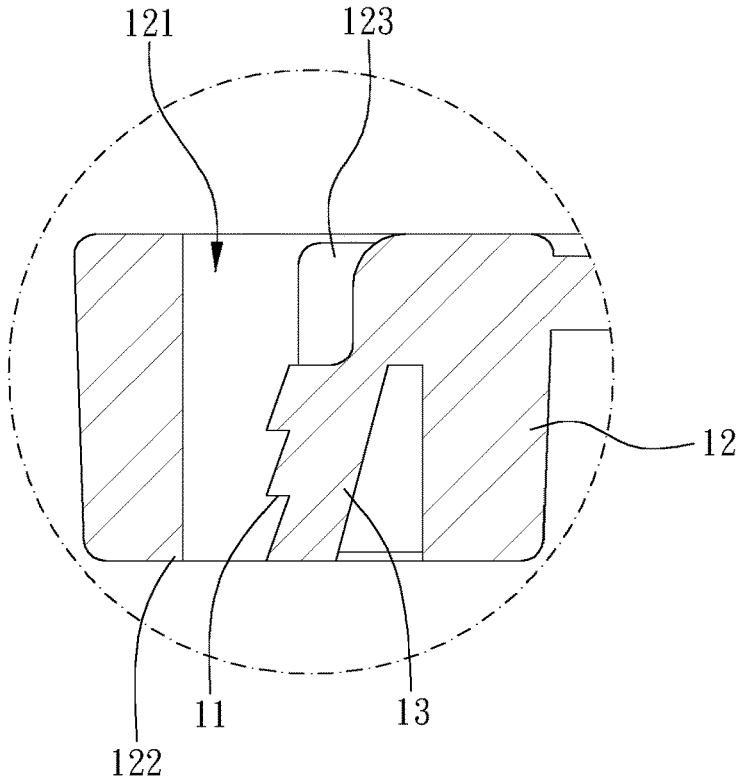
FIG. 2 is an enlarged cross-sectional view of a locking head according to a preferable embodiment of the present invention.
Figure 3:
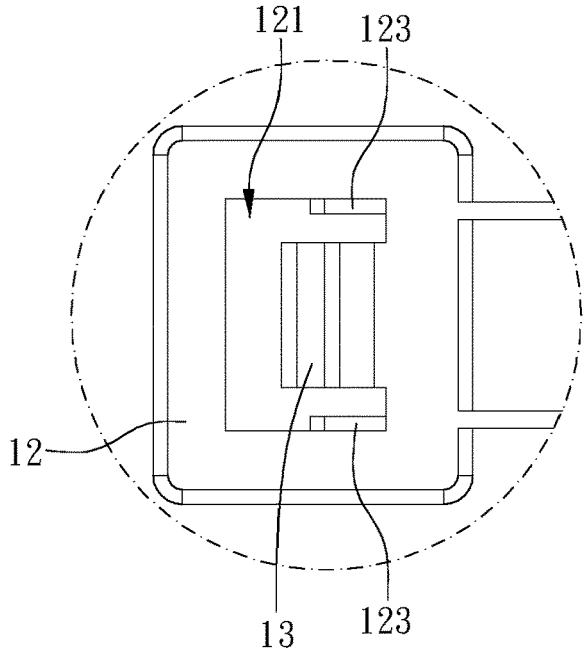
FIG. 3 is an enlarged top view of the locking head according to a preferable embodiment of the present invention.
Figure 7:
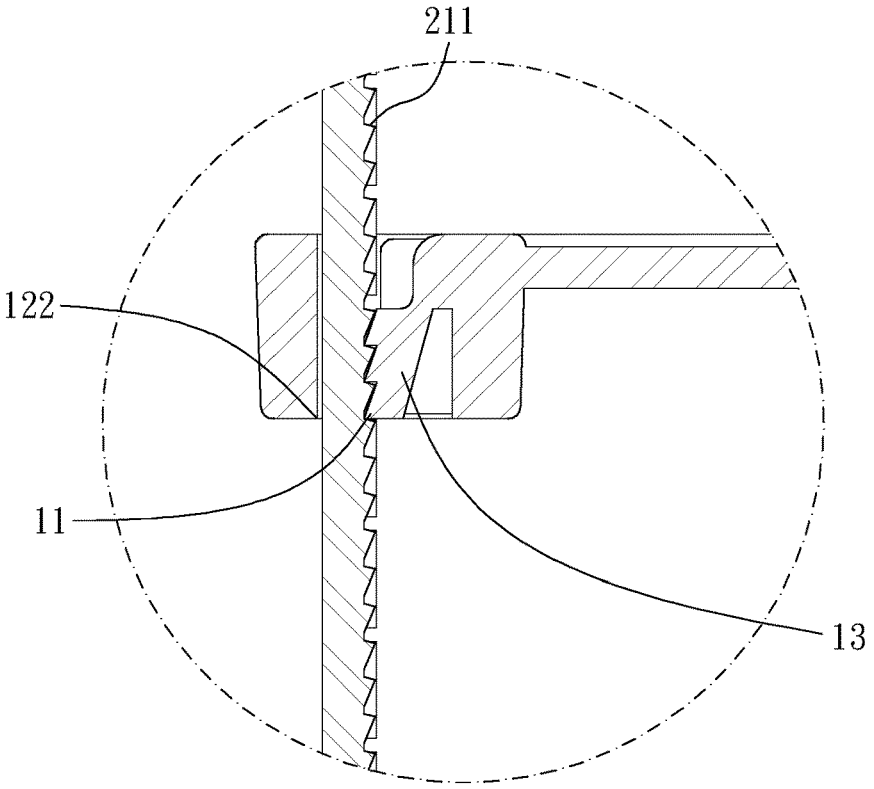
FIGS. 7 and 8 are drawings showing operation according to a preferable embodiment of the present invention.
Figure 8:
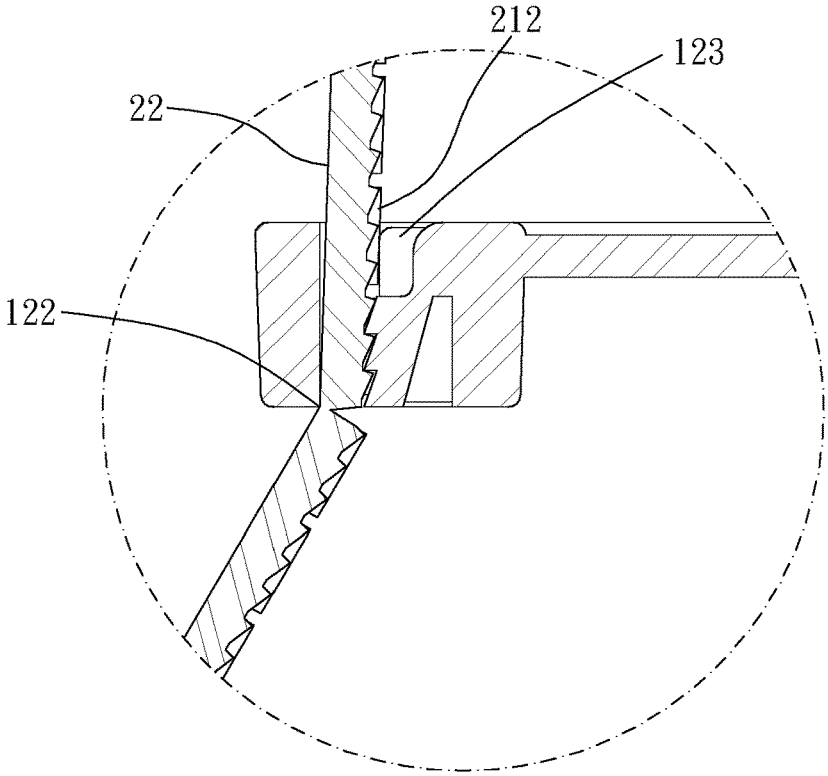

Please refer to FIGS. 2 and 3, the locking head 10 includes a main body 12 and a locking portion 13 having the plurality of first engaging teeth 11 disposed thereon. The main body 12 defines a channel 121 extending in a direction lateral to the longitude direction L, and the locking portion 13 is swingably connected with the main body 12 and located within the channel 121. When the strap body 20 is passing through the channel 121, the locking portion 13 is urged by the plurality of second engaging teeth 211 and elastically swung relative to the main body 12. Preferably, the main body 12 has a corner 122 located at an outlet of the channel 121; when the strap body 20 is disposed through the channel 121, the second surface 22 is abuttable against the corner 122 to broken the strap body 20 through one of the plurality of notched portions 24, as shown in FIGS. 7 and 8. The corner 122 provides a line contact with the second surface 22 and the force exerted on the strap body 20 is concentrated thereon, which is convenient to disconnect the strap body 20. In this embodiment, the main body 12 further includes two abutting portions 123 located at two opposite sides of the locking portion 13, and the two abutting portions 123 correspond to and are abuttable against the two protruding edges 212 when the strap body 20 is disposed through the channel 121. Therefore, the plurality of second engaging teeth 211 and the plurality of first engaging teeth 11 are stably engaged, which avoids relative movement of the locking portion 13 and the strap body 20 during bending the strap body 20. Specifically, a length of each of the two abutting portions 123 is at least ½ of a length of the channel 121 so as to provide stable abutment; and the locking head 10 and the strap body 20 are integrally formed in one piece, which is convenient to manufacture and has good structural strength.

Figure 5:
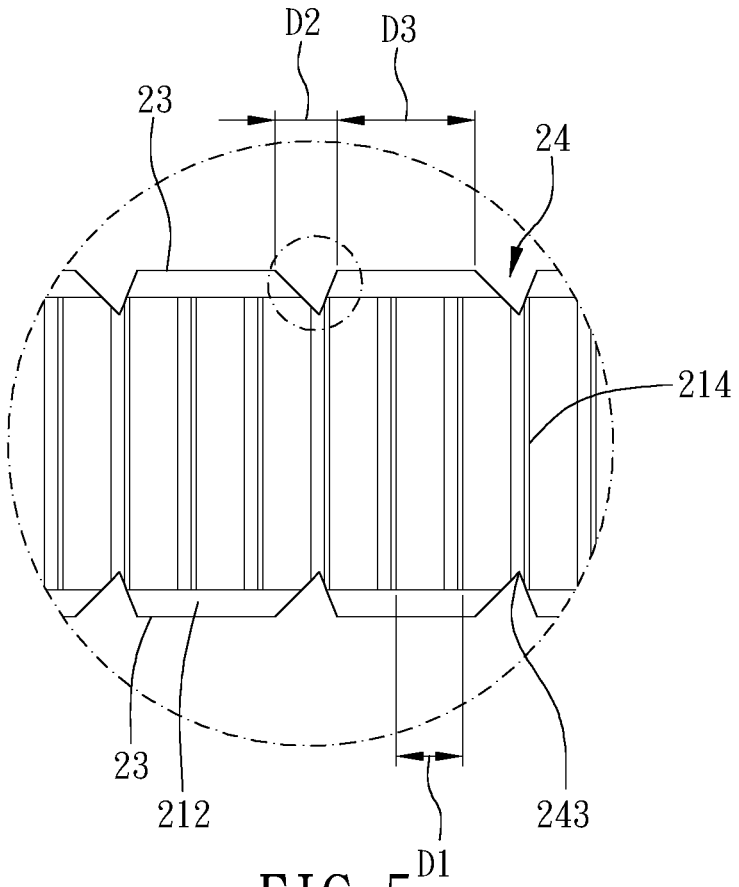
FIG. 5 is an enlarged top view of the strap body according to a preferable embodiment of the present invention.
Figure 6:
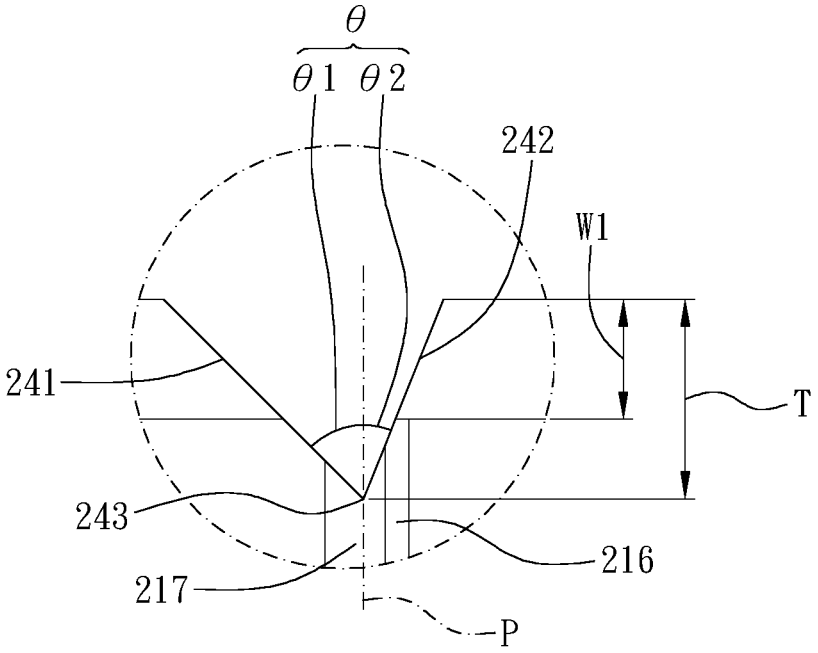
FIG. 6 is an enlargement of FIG. 5.

Please refer to FIGS. 5 and 6, every adjacent two of the plurality of second engaging teeth 211 define an engaging recess 213 therebetween, and each of the plurality of notched portions 24 is tapered in a direction toward one of said engaging recesses 213 so as to have good force transmission. A depth T of each of the plurality of notched portions 24 is respectively greater than a depth of one of said engaging recesses 213 (being the same as H2 in this embodiment) and a width W1 of one of the two protruding edges 212 so that the strap body 20 has relative weak structural strength at positions corresponding to the plurality of notched portions 24, which ensures that the strap body 20 can be accurately fractured at the desired position. In this embodiment, every adjacent two of the plurality of notched portions 24 have three of the plurality of second engaging teeth 211 arranged therebetween, and the plurality of notched portions 24 are equally spaced from one another in the longitude direction L. The strap body 20 has good flexibility and is not easy to fracture unexpectedly.

Figure 4:
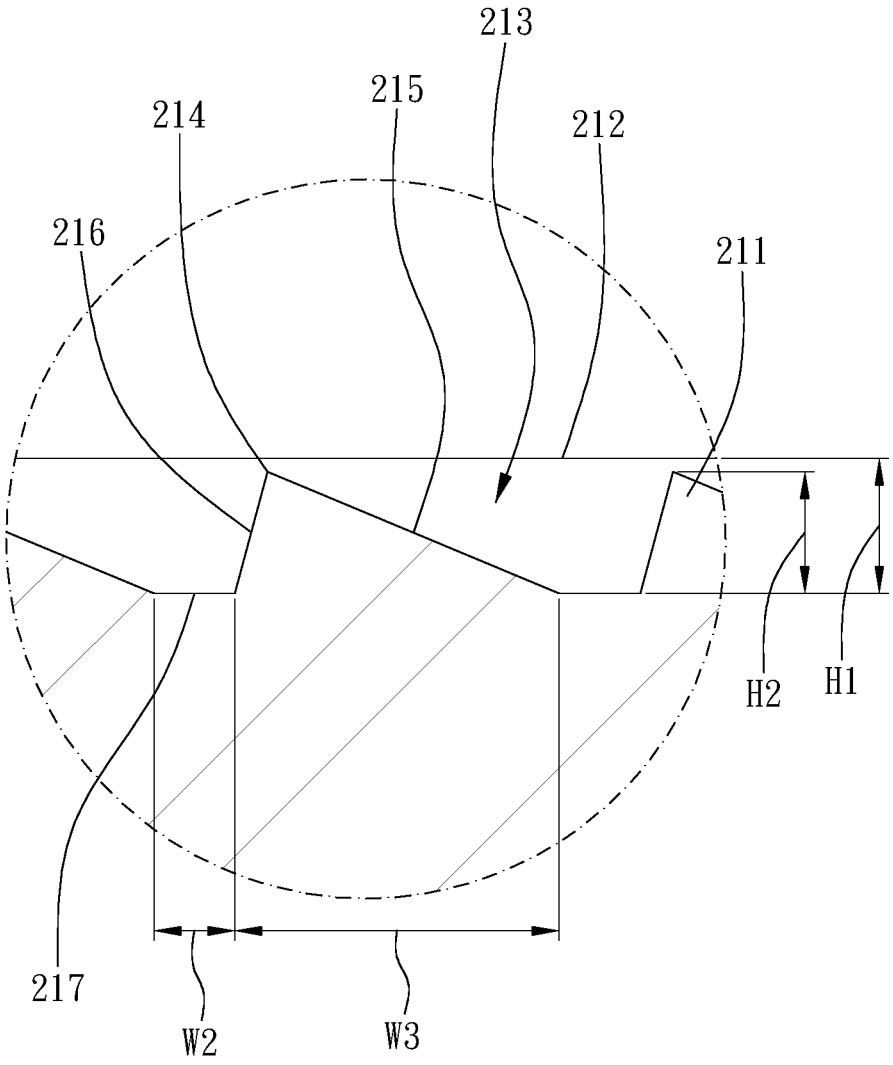
FIG. 4 is an enlarged cross-sectional view of a strap body according to a preferable embodiment of the present invention.

Specifically, each of the plurality of notched portions 24 includes a first cutting surface 241 and a second cutting surface 242 extending toward each other, and an extending length of the first cutting surface 241 is greater than an extending length of the second cutting surface 242. The first cutting surface 241 and the second cutting surface 242 of each of the plurality of notched portions 24 are connected with each other and formed a connecting edge 243, and each said connecting edge 243 is close to a tooth peak 214 of one of adjacent two of the plurality of second engaging teeth 211. Each of the plurality of second engaging teeth 211 includes a guiding surface 215 and an abutting surface 216 being more oblique than the guiding surface 215, the guiding surface 215 and the abutting surface 216 define one said tooth peak 214 therebetween, as shown in FIG. 4. Each said first cutting surface 241 corresponds to the guiding surface 215 of one of the plurality of second engaging teeth 211, and each said second cutting surface 242 corresponds to the abutting surface 216 of another one of the plurality of second engaging teeth 211. Therefore, each of the plurality of weaken segments is relative close to one of said abutting surface 216 which provides a structural strength greater than one of said guiding surface 215 so as to avoid damage to a structure of the plurality of second engaging teeth 211.

Furthermore, the first cutting surface 241 and the second cutting surface 242 of each of the plurality of notched portions 24 define an acute angle θ therebetween, and the acute angle θ is greater than 10 degrees and less than 80 degrees (preferably greater than 50 degrees), as shown in FIG. 6. An imaginary plane P is defined as a plane vertical to the longitude direction L and passing through a vertex of the acute angle θ. The imaginary plane P divides the acute angle θ into a first angle θ1 adjacent to one said first cutting surface 241 and a second angle θ2 adjacent to one said second cutting surface 242, and the first angle θ1 is larger than the second angle θ2. Preferably, the first angle θ1 is between 35 degrees and 55 degrees, and the second angle θ2 is between 15 degrees and 25 degrees, which facilitates the force exerted on the strap body 20 to transmit and accumulate to one of said weaken segments for accurate fracture. In this embodiment, the first angle θ1 is about 45 degrees, and the second angle θ2 is about 22 degrees. However, the first angle and the second angle may be other degrees according to requirements.

In the longitude direction L, a distance between tooth peaks 214 of adjacent two of the plurality of second engaging teeth 211 is defined as a first distance D1, a width of an opening of each of the plurality of notched portions 24 on one of the two lateral sides 23 is defined as a second distance D2, and the second distance D2 is smaller than or equal to two times of the first distance D1, which prevents a structure of the strap body 20 from over-weakening by the plurality of notched portions 24. A distance between adjacent two of the plurality of notched portions 24 is defined as a third distance D3, and the third distance D3 is greater than or equal to two times of the first distance D1 so as to avoid damage to the plurality of second engaging teeth 211 after fracturing the strap body 20. Preferably, a length of the channel 121 is greater than a sum of the second distance D2 and the third distance D3 so as to stably guide the two lateral sides 23 for smooth movement.

Moreover, the first surface 21 further includes a plurality of flat surfaces 217 each located between adjacent two of the plurality of second engaging teeth 211, and each of the plurality of notched portions 24 extends from one of the two lateral sides 23 to one of the plurality of flat surfaces 217. In this embodiment, each of the plurality of weaken segments is defined by one of the plurality of flat surfaces 217 and two of the plurality of notched portions 24 aligned with said flat surface 217. In the longitude direction L, a width W2 of each of the plurality of flat surfaces 217 is smaller than a width W3 of one of the plurality of second engaging teeth 211, and the width W2 of each of the plurality of flat surfaces 217 is smaller than the second distance D2 so that the strap body 20 can be accurately fractured at one of the plurality of flat surfaces 217 without cutting tools. Preferably, the connecting edge 243 of each of the plurality of notched portions 24 is located at a side of one of the plurality of flat surfaces 217 close to one said abutting surface 216, which prevents each said guiding surface 215 from being damaged.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A cable tie, including:

a locking head, including a plurality of first engaging teeth; and a strap body, connected with the locking head and defining a longitude direction, including a first surface, a second surface opposite to the first surface and two lateral sides respectively connected between the first surface and the second surface, the first surface having a plurality of second engaging teeth and two protruding edges disposed thereon, the plurality of second engaging teeth being engageable with the plurality of first engaging teeth, the two protruding edges disposed on two opposite sides of the plurality of second engaging teeth;

wherein a plurality of notched portions are spacedly disposed on the two lateral sides and interrupts the two protruding edges, and based on the first surface, a height of each of the two protruding edges is greater than a height of each of the plurality of second engaging teeth;

wherein each of the plurality of notched portions includes a first cutting surface and a second cutting surface extending toward each other, and an extending length of the first cutting surface is greater than an extending length of the second cutting surface.

2. The cable tie of claim 1, wherein every adjacent two of the plurality of second engaging teeth define an engaging recess therebetween, and each of the plurality of notched portions is tapered in a direction toward one of said engaging recesses.

3. The cable tie of claim 2, wherein a depth of each of the plurality of notched portions is respectively greater than a depth of one of said engaging recesses and a width of one of the two protruding edges.

4. The cable tie of claim 1, wherein every adjacent two of the plurality of notched portions have three of the plurality of second engaging teeth arranged therebetween.

5. The cable tie of claim 1, wherein the first cutting surface and the second cutting surface of each of the plurality of notched portions are connected with each other and formed a connecting edge, and each said connecting edge is close to a tooth peak of one of adjacent two of the plurality of second engaging teeth.

6. The cable tie of claim 5, wherein each of the plurality of second engaging teeth includes a guiding surface and an abutting surface being more oblique than the guiding surface, the guiding surface and the abutting surface define one said tooth peak therebetween, each said first cutting surface corresponds to the guiding surface of one of the plurality of second engaging teeth, and each said second cutting surface corresponds to the abutting surface of another one of the plurality of second engaging teeth.

7. The cable tie of claim 1, wherein the first cutting surface and the second cutting surface of each of the plurality of notched portions are connected with each other and define an acute angle therebetween, and the acute angle is greater than 10 degrees and less than 80 degrees.

8. The cable tie of claim 7, wherein an imaginary plane is defined as a plane vertical to the longitude direction and passing through a vertex of the acute angle, the imaginary plane divides the acute angle into a first angle adjacent to one said first cutting surface and a second angle adjacent to one said second cutting surface, and the first angle is larger than the second angle.

9. A cable tie, including:

a locking head, including a plurality of first engaging teeth; and a strap body, connected with the locking head and defining a longitude direction, including a first surface, a second surface opposite to the first surface and two lateral sides respectively connected between the first surface and the second surface, the first surface having a plurality of second engaging teeth and two protruding edges disposed thereon, the plurality of second engaging teeth being engageable with the plurality of first engaging teeth, the two protruding edges disposed on two opposite sides of the plurality of second engaging teeth;

wherein a plurality of notched portions are spacedly disposed on the two lateral sides and interrupts the two protruding edges, and based on the first surface, a height of each of the two protruding edges is greater than a height of each of the plurality of second engaging teeth;

wherein in the longitude direction, a distance between tooth peaks of adjacent two of the plurality of second engaging teeth is defined as a first distance, a width of an opening of each of the plurality of notched portions on one of the two lateral sides is defined as a second distance, and the second distance is smaller than or equal to two times of the first distance.

10. The cable tie of claim 1, wherein in the longitude direction, a distance between tooth peaks of adjacent two of the plurality of second engaging teeth is defined as a first distance, a distance between adjacent two of the plurality of notched portions is defined as a third distance, and the third distance is larger than or equal to two times of the first distance.

11. A cable tie, including:

a locking head, including a plurality of first engaging teeth; and a strap body, connected with the locking head and defining a longitude direction, including a first surface, a second surface opposite to the first surface and two lateral sides respectively connected between the first surface and the second surface, the first surface having a plurality of second engaging teeth and two protruding edges disposed thereon, the plurality of second engaging teeth being engageable with the plurality of first engaging teeth, the two protruding edges disposed on two opposite sides of the plurality of second engaging teeth;

wherein a plurality of notched portions are spacedly disposed on the two lateral sides and interrupts the two protruding edges, and based on the first surface, a height of each of the two protruding edges is greater than a height of each of the plurality of second engaging teeth;

wherein the first surface further includes a plurality of flat surfaces each located between adjacent two of the plurality of second engaging teeth, and each of the plurality of notched portions extends from one of the two lateral sides to one of the plurality of flat surfaces.

12. The cable tie of claim 11, wherein in the longitude direction, a width of each of the plurality of flat surfaces is smaller than a width of one of the plurality of second engaging teeth.

13. The cable tie of claim 11, wherein in the longitude direction, a width of each of the plurality of flat surfaces is smaller than a second distance defined as a width of an opening of one of the plurality of notched portions on one of the two lateral sides.

14. The cable tie of claim 1, wherein the locking head includes a main body and a locking portion having the plurality of first engaging teeth disposed thereon, the main body defines a channel extending in a direction lateral to the longitude direction, the locking portion is swingably connected with the main body and located within the channel, the main body has a corner located at an outlet of the channel; and when the strap body is disposed through the channel, the second surface is abuttable against the corner to broken the strap body through one of the plurality of notched portions.

15. The cable tie of claim 14, wherein the main body further includes two abutting portions located at two opposite sides of the locking portion, and the two abutting portions correspond to and are abuttable against the two protruding edges when the strap body is disposed through the channel.

16. The cable tie of claim 14, wherein in the longitude direction, a width of an opening of each of the plurality of notched portions on one of the two lateral sides is defined as a second distance, a distance between adjacent two of the plurality of notched portion is defined as a third distance, and a length of the channel is greater than a sum of the second distance and the third distance.

17. The cable tie of claim 6, wherein every adjacent two of the plurality of second engaging teeth define an engaging recess therebetween, and each of the plurality of notched portions is tapered in a direction toward one of said engaging recesses; a depth of each of the plurality of notched portions is respectively greater than a depth of one of said engaging recesses and a width of one of the two protruding edges; the plurality of notched portions are equally spaced from one another in the longitude direction; every adjacent two of the plurality of notched portions have three of the plurality of second engaging teeth arranged therebetween; the first cutting surface and the second cutting surface of each of the plurality of notched portions define an acute angle therebetween, and the acute angle is greater than 50 degrees and less than 80 degrees; an imaginary plane is defined as a plane vertical to the longitude direction and passing through a vertex of the acute angle, the imaginary plane divides the acute angle into a first angle adjacent to one said first cutting surface and a second angle adjacent to one said second cutting surface, and the first angle is larger than the second angle; the first angle is between 35 degrees and 55 degrees, and the second angle is between 15 degrees and 25 degrees; in the longitude direction, a distance between tooth peaks of adjacent two of the plurality of second engaging teeth is defined as a first distance, a width of an opening of each of the plurality of notched portions on one of the two lateral sides is defined as a second distance, and the second distance is smaller than or equal to two times of the first distance; a distance between adjacent two of the plurality of notched portions is defined as a third distance, and the third distance is larger than or equal to two times of the first distance; the first surface further includes a plurality of flat surfaces each located between adjacent two of the plurality of second engaging teeth, and each of the plurality of notched portions extends from one of the two lateral sides to one of the plurality of flat surfaces; the connecting edge of each of the plurality of notched portions is located at a side of one of the plurality of flat surfaces close to one said abutting surface; in the longitude direction, a width of each of the plurality of flat surfaces is smaller than a width of one of the plurality of second engaging teeth; in the longitude direction, the width of each of the plurality of flat surfaces is smaller than the second distance; the locking head includes a main body and a locking portion having the plurality of first engaging teeth disposed thereon, the main body defines a channel extending in a direction lateral to the longitude direction, the locking portion is swingably connected with the main body and located within the channel, the main body has a corner located at an outlet of the channel; and when the strap body is disposed through the channel, the second surface is abuttable against the corner to broken the strap body through one of the plurality of notched portions; the main body further includes two abutting portions located at two opposite sides of the locking portion, and the two abutting portions correspond to and are abuttable against the two protruding edges when the strap body is disposed through the channel; a length of each of the two abutting portions is at least ½ of a length of the channel; a length of the channel is greater than a sum of the second distance and the third distance; and the locking head and the strap body are integrally formed in one piece.

* * * * *